United States Patent [19]

Tsao

[11] Patent Number: 4,848,307

[45] Date of Patent: Jul. 18, 1989

[54] TOY AIR PISTOL FOR LAUNCHING MISSILE BULLET

[76] Inventor: Yung-Chi Tsao, No. 3-1, Lane 20, Jing-Ming 1 Street, Taichung, Taiwan

[21] Appl. No.: 195,838

[22] Filed: May 19, 1988

[51] Int. Cl.[4] ..... F41B 11/02

[52] U.S. Cl. ..... 124/59; 124/66; 124/67

[58] Field of Search ..... 124/31, 37, 59, 63–67, 124/72, 83; 42/59, 65

[56] References Cited

U.S. PATENT DOCUMENTS

| | | | |
|---|---|---|---|
| 530,730 | 12/1894 | Smith | 42/59 |
| 689,923 | 12/1901 | Simonds et al. | 124/67 |
| 995,146 | 6/1911 | Jeffries | 124/67 |
| 1,116,675 | 11/1914 | Cook | 124/67 |
| 1,537,369 | 5/1925 | Nicholson | 42/59 |
| 1,692,555 | 11/1928 | Lewis | 124/67 |
| 2,194,142 | 3/1940 | Foss | 124/67 |
| 2,324,674 | 7/1943 | Buchanan | 42/65 |
| 3,453,763 | 7/1969 | Barr et al. | 42/95 |
| 3,726,266 | 4/1973 | Palmer | 124/59 |
| 4,367,723 | 1/1983 | Resuggan | 124/67 |

FOREIGN PATENT DOCUMENTS

| | | | |
|---|---|---|---|
| 230770 | 12/1963 | Austria | 42/59 |
| 1115157 | 10/1961 | Fed. Rep. of Germany | 124/67 |
| 480612 | 5/1953 | Italy | 124/67 |
| 20560 | of 1901 | United Kingdom | 124/67 |

*Primary Examiner*—Randolph A. Reese
*Assistant Examiner*—John A. Ricci
*Attorney, Agent, or Firm*—Wenderoth, Lind & Ponack

[57] ABSTRACT

A toy air pistol for launching missile bullets includes chiefly an air-compression mechanism and a triggering mechanism, a revolving cylinder, and a barrel. The revolving cylinder has several cartridge chambers for loading missile bullets. The air hole of the air-compression mechanism can be aligned with any one of the cartridge chambers. The triggering mechanism releases the compression spring and piston to generate a powerful air pressure out of the air hole to launch the missile bullet out of the barrel. The missile bullet has a trumpet-shaped tail and an air chamber extending almost the whole length of the body thereof for receiving the air pressure as a propelling force for the missile bullet. The front end of the missile bullet may be mounted with an explosive charge or a protective cap so as to have the bullet look and act like a real one, or to increase its safety during play.

2 Claims, 4 Drawing Sheets

TOY AIR PISTOL FOR LAUNCHING MISSILE BULLET

BACKGROUND OF THE INVENTION

1. Field of the Invention

This invention provides a toy air pistol for launching a missile bullet; particularly, it relates to an air pistol comprising an air-compression mechanism and a triggering mechanism inside the pistol body portion. When pulling the trigger, the piston will compress the air swiftly to push the missile bullet out of the barrel to let the player imagine a real missile being launched.

2. Description of the Prior Art

The children toys in the current are varied; for instance, there are many different kinds only for the toy gun. Most of them can only provide a sound, or sound and light. Some of them may be able to launch light weight bullets by means of explosive or spring force; the toy gun using explosive can only launch its bullet at very short range, while the gun using spring as a launching power would soon fail to launch bullet as a result of metal fatigue.

SUMMARY OF THE INVENTION

In view of the drawbacks of the aforesaid prior art, the inventor has developed a toy air pistol that can launch a missile-shaped bullet by means of an air pressure. The feature of the present invention is that an air-compression mechanism is installed inside the pistol body portion, and it can compress the air into a given powerful pressure. The pistol of the present invention comprises also a triggering mechanism for launching the bullet upon the trigger being pulled. It is deemed that the present invention has a highly amusement result and a high safety to the player.

DETAILED DESCRIPTION OF THE PREFERRED EMBODIMENT

Figure 1:
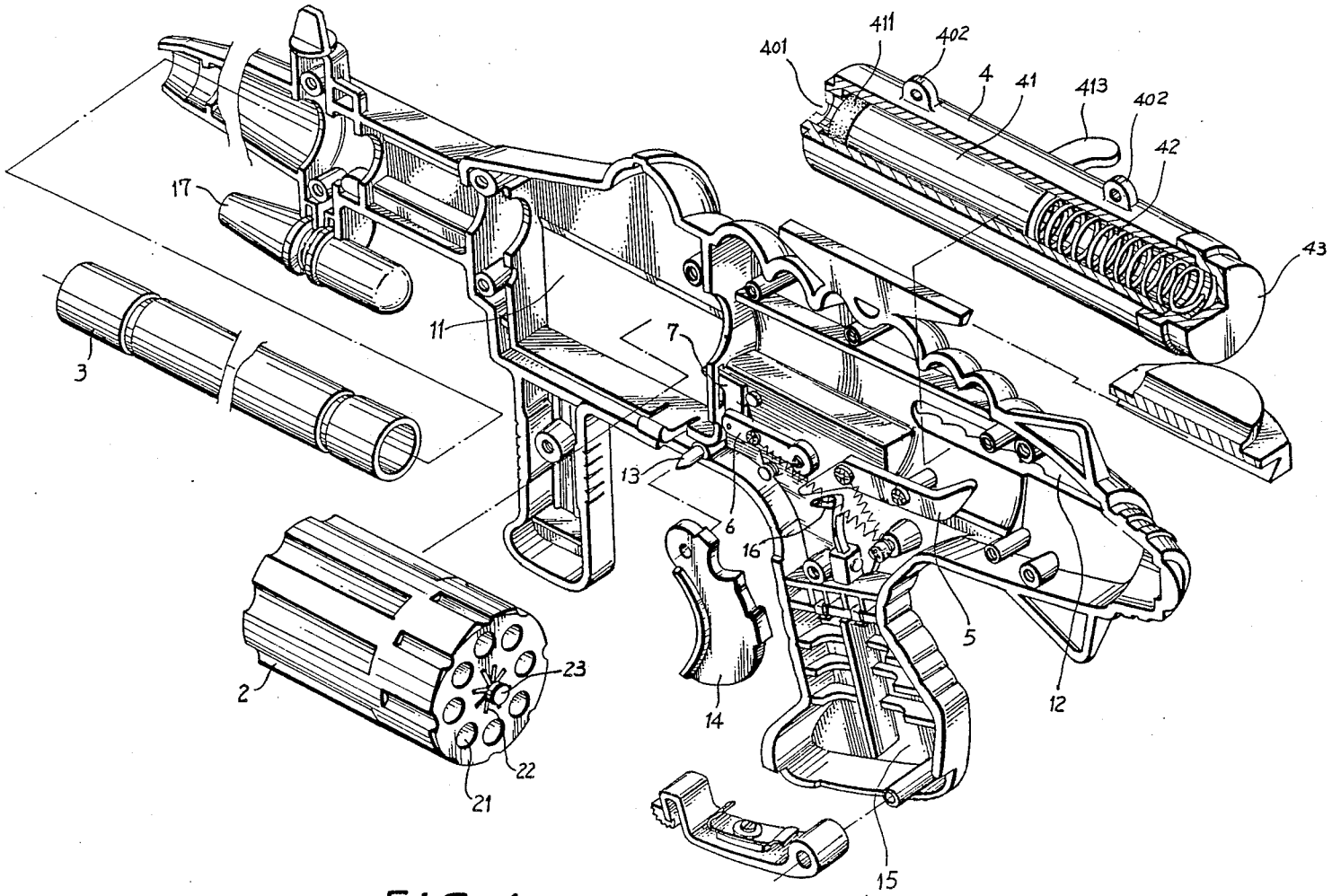
FIG. 1 is a disassembled view of the embodiment according to the present invention.
Figure 2:
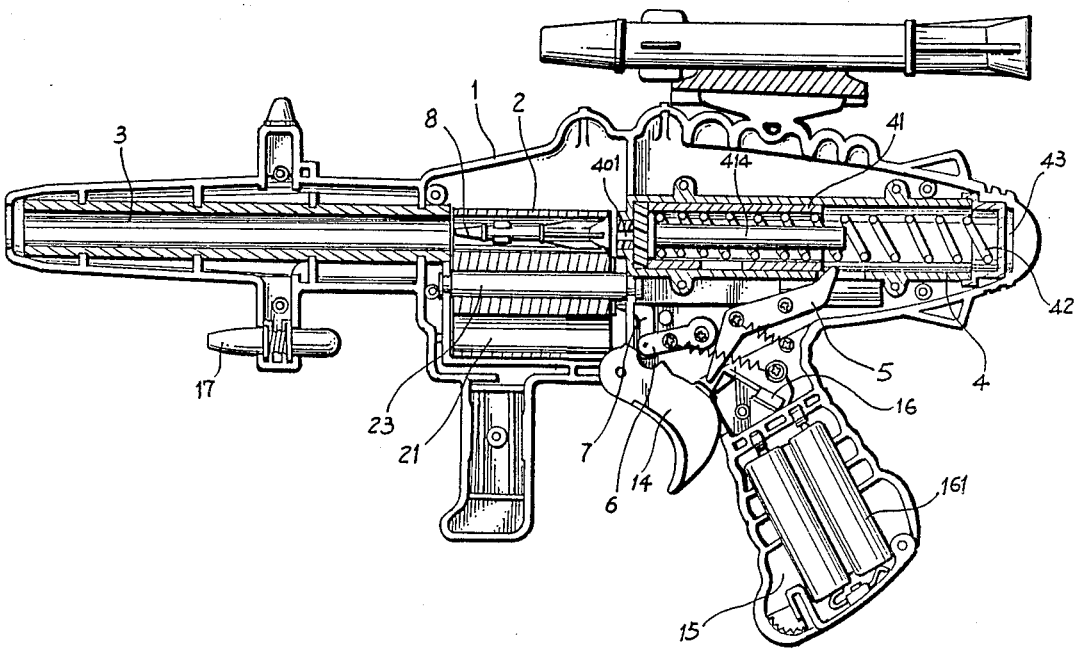
FIG. 2 is a sectional view of the present invention.

Referring to FIG. 1, there is shown the body comprising two body parts 1, which are assembled together with a plurality of screws. The space behind the barrel is a hollow space for mounting therein an air-compression mechanism and a triggering mechanism. The middle portion of the body portion of the air pistol has a space 11 for mounting a revolving cylinder 2. A barrel 3 is mounted in the front of the body portion, through which a missile bullet is to be shot out. One of the two body parts 1 has a lateral channel portion 12. Under the space 11, there is mounted with a supporting axle 13 for positioning a trigger 14. The handle 15 has an inner hollow space to be used as a battery chamber 16 for receiving battery 161 and mounting a leaf-spring switch 162. The switch 162 is connected with the bulb 17 on the outside of the barrel by means of wire. When . the trigger 14 is pulled, the leaf-spring switch 162 will turn on the circuit as shown in FIG. 2 to light up the bulb.

The major features designed in the present invention are the air-compression mechanism, the positioning and stop mechanism, and the structure of the missile bullet, which are described respectively as follows:

Referring to FIG. 1, there shows the air-compression mechanism, which comprises a cylinder 4, a piston 41, a compression spring 42, and a rear cap 43. The front end of the cylinder 4 has an air hole 401, and two sets of lugs 402 on the outer surface thereof so as to fix the cylinders 4 with screws in the hollow space of the body portion. Under the mid-portion of the cylinder 4, there is an elongated hole 403; also, there is a slot 404 under the cylinder 4 extended from the middle portion to the rear end of the cylinder 4. A piston 41 is mounted inside the cylinder 4; the front end of the piston 41 is in a closed condition, being mounted with a flexible collar seal 411. Under the front end of the piston, there is a stop hole 412, and the rear end of the piston is furnished with a pulling handle 413 extending out of the cylinder 4 beside the slot 404 so as to prevent the piston 41 from rotating radially. The inner part of the piston 41 is a hollow space, in which a rod 414 and a compression spring 42 are mounted. The compression spring 42 is mounted in the piston, and extending out of the piston until the rear end of the cylinder 4, and it is limited within the cylinder 4 by means of a rear cap 43 attached on the rear end of the cylinder 4; the compression spring 42 can only be compressed and can extend axially within and between the piston 41 and the cylinder 4. By means of a rod 414, the spring 42 would not be bent upon being compressed. The rear cap 43 is used for closing the rear end of the cylinder 4 as a stop member of the compression spring 42.

Figure 3:
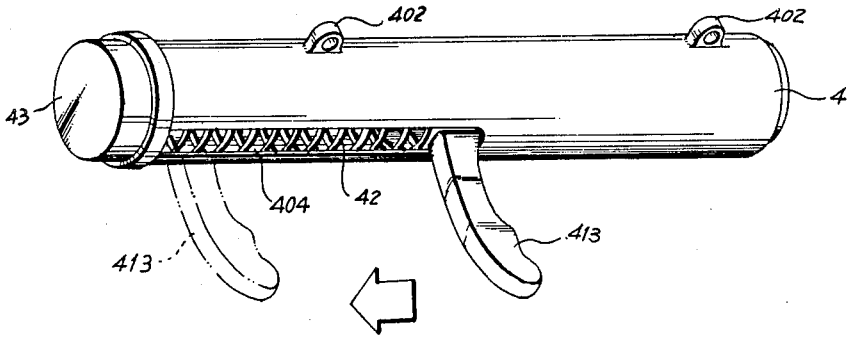
FIG. 3 is a perspective view of the air-compression mechanism in the present invention.

FIG. 3 illustrates a perspective view of the air-compression mechanism, and the operation condition of the piston 41 being pulled with a pulling handle 413. FIG. 2 shows a sectional view of the position and assembled state of the air-compression mechanism. After the air-compression mechanism being mounted in place, the air hole 401 of the cylinder 4 will be in alignment with any one of cartridge chambers 21 of the revolving cylinder 2.

The triggering mechanism of the present invention comprises a trigger 14, a rocking lever 6 and a stop lever 5. The stop lever 5 is mounted on the body part 1 by means of a screw 51, which is also used as a fulcrum to make the lever 5 rock. The rear end of the stop lever 5 is also used as a stop member 52 upon moving upwards at an angle because of the stop member 52 extending into the elongated hole 403 of the aforesaid cylinder 4. The front end of the stop lever 5 is used as a pushing member 53. Between the pushing member 53 and the screw 51, there is a screw 54 to fix one end of a pulling spring 55, while the other end of the spring 55 is fixed with a screw (not shown) to the body part. The stop lever 5 would have its stop member 52 moved upwards upon being pulled by the pulling spring 55. The rocking lever 6 is mounted on the body part 1 with a screw 61 as a fulcrum so as to have the lever 6 rock. The mid-part of the rocking lever 6 has a screw 62 to fix one end of a pulling spring 63, while the other end of the spring 63 is fixed to the body part 1 with a screw; the rocking level 6 would swing downward upon being pulled by the spring 63. The free end of the rocking lever 6 has a round and smooth portion being engaged in a curved recess 141 on the upper rear portion of the trigger 14; when the trigger 14 being pulled, the rocking lever 6 will be pushed upwards at a given distance. The upper end of the rocking lever 6 is mounted with a driving lever 7, of which the lever end is in contact with the free end of the rocking lever 6, while the upper end of the lever 7 is furnished with a right-angle portion extending toward the barrel direction through the body part 1, being engaged with one of the driven teeth 22, of which the function is to be described herein after.

Figure 4:
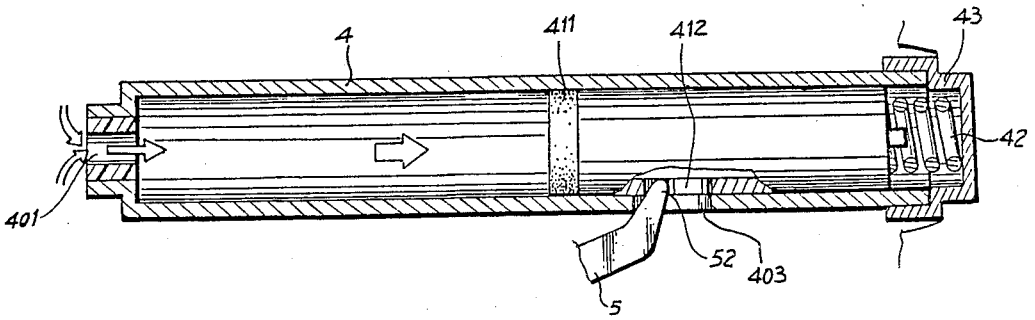
FIGS. 4 and 5 illustrate the operation of the air-compression mechanism of the present invention.
Figure 5:
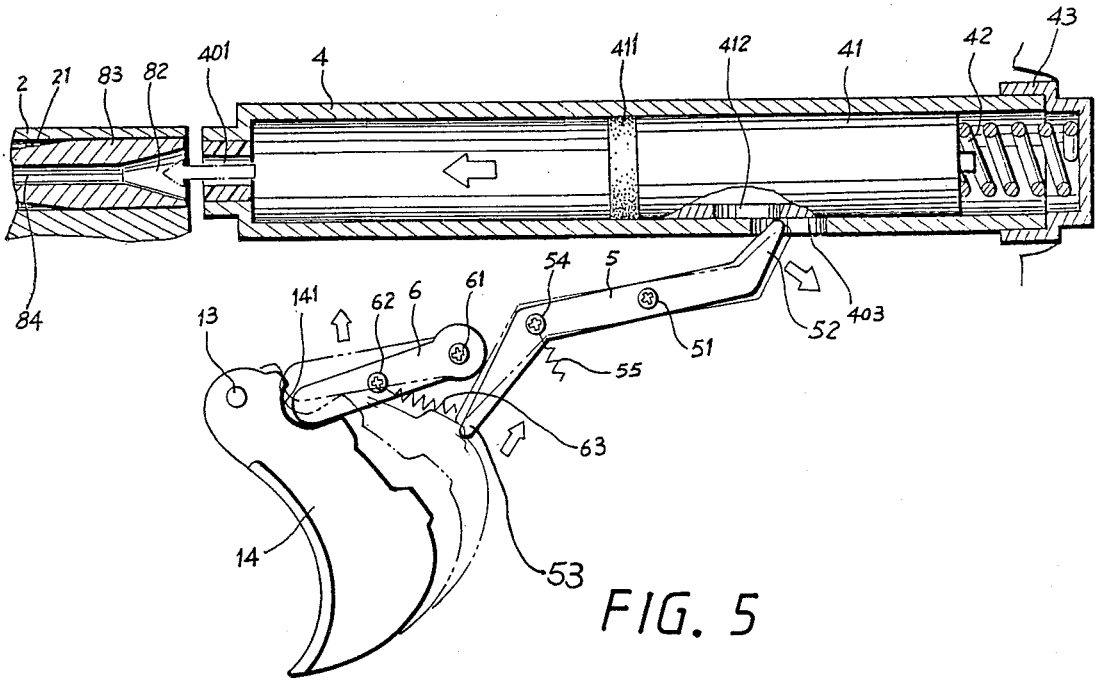

According to the aforesaid pistol structure, the revolving cylinder 2 has a plurality of cartridge chambers 21, i.e., through holes for guiding the missile bullets. Each of the driven teeth 22 at the rear end of the revolving cylinder 2 is corresponding, in position, to each of the cartridge chamber 21. After the revolving cylinder 2 being mounted in the space 11 by means of the supporting pivot 23 pivotally engaged with the body part 1, the revolving cylinder 2 can be driven to revolve; in that case, one of the cartridge chambers 21 will be in alignment with the air hole 401 of the air-compression mechanism and the barrel 3. With the pulling handle 413 being pulled backwards as shown in FIGS. 4 and 5, the piston 41 will be moved backwards to such an extent that the stop hole 412 on the front portion of the piston 41 is aligned with the elongated hole 403 of the cylinder 4; then, the stop member 52 of the stop lever 5 will enter the stop hole 412 to prevent the piston 41 from moving axially. The compression spring 42 between the piston 41 and the rear cap 43 is under a compressed state; the cylinder 4 would take in a lot of air from the air hole 401 to be compressed later for generating a powerful pushing force.

Referring to FIG. 5, it shows that, when the trigger 14 is pulled, the rear edge of the trigger 14 will push the pushing member 53 of the stop lever 5 to cause the lever 5 to turn at an angle around the screw 51 as a fulcrum; as a result, the stop member 52 of the lever 5 moves downwards and out of the stop hole 412 of the piston 41 to release the piston 41, and then the compression spring 42 is released immediately to push the piston 41 forwards rapidly for compressing the air inside the cylinder 4. The air under high pressure will be jetted out of the air hole 401 to drive the missile bullet in the cartridge chamber 21 to shoot out. Simultaneously, when the trigger 14 being pulled, the free end of the rocking lever 6 would move upwards at a given angle to push the upper end of the driving lever 7 upwards to bias at an angle so as to drive the revolving cylinder 2 to rotate one step (because of that upper end being engaged with the driven tooth 22); then, one of the cartridge chambers 21 will be in alignment with the air hole 401. In other words, with the trigger 14 being pulled once, the driving lever 7 will be actuated to drive the revolving cylinder 2 to rotate one step so as to have one cartridge chamber 21 aligned with the air hole 401 (because of the rocking lever 6 being engaged with the trigger 14, and the driving lever 7 being actuated first); then, the stop lever 5 is to be actuated to cause the piston 41 to compress the air. After the trigger 14 is released, the rocking lever 6 and the stop lever 5 will return to their former positions respectively as a result of the pulling springs 63 and 55, and the next operation will be ready. The driving lever 7 is mounted with a return spring (not shown) for pulling the lever back to its former and standby position. When the trigger 14 is pulled, the rear edge of the trigger will push a leaf-spring switch 162 to turn on a bulb circuit, and the bulb will be lighted up upon the pistol firing the bullets. So as to increase the fun when playing with the toy.

Figure 6:
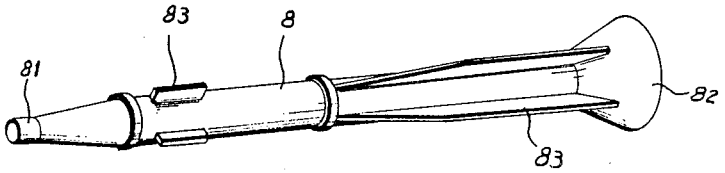
FIG. 6 is a perspective view of the missile bullet being used in the present invention.
Figure 7:
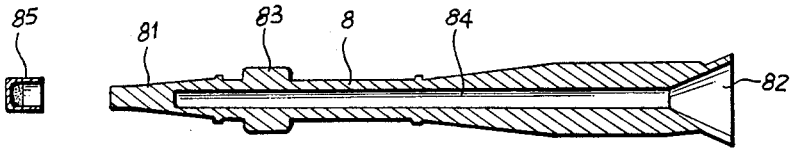
FIG. 7 is a sectional view of FIG. 6.
Figure 8:
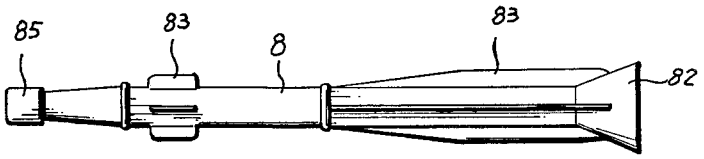
FIG. 8 is a perspective view of FIG. 7.
Figure 9:
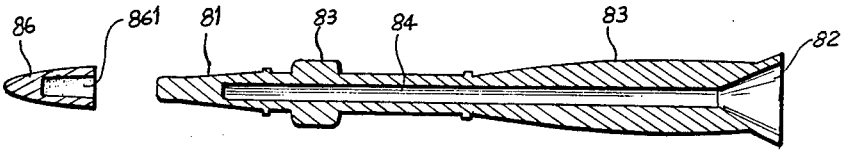
FIGS. 9 and 10 illustrate another embodiment of the structure shown in FIG. 8.
Figure 10:
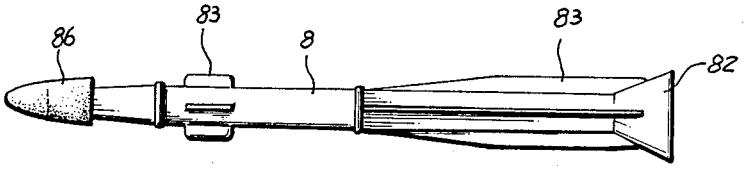

The missile bullet 8 according to the present invention is shown in FIG. 6; the bullet 8 includes a conic portion 81, a trumpet-shaped tail 82, and several stabilizing fins 83 being furnished symmetrically around the outer surface thereof. Inside the missile bullet, there is an air chamber 84, of which the front end is closed, while the rear end is opened, being in communication with the trumpet-shaped tail 82. After the missile bullet 8 has been loaded in the cartridge chamber 21 of the revolving cylinder 2, the trumpet-shaped tail 82 is the only portion in contact with the inner surface of the cartridge chamber 21 for holding the bullet 8 in position; the other surface portions of the bullet 8 are not in contact with the inner surface of the cartridge chamber 21 as shown in FIG. 2 so as to minimize the frictional resistance during the bullet being shot. The trumpet-shaped tail portion of missile bullet 8 can completely cover the air hole 401, and therefore the powerful air pressure generated by the piston 41 would enter into the air chamber 84 completely to drive the missile bullet 8 out of the barrel. FIG. 7 illustrates a sectional view of the missile bullet 8. In order to let the missile bullet 8 resemble a missile, the front conic portion 81 of the bullet is mounted with a explosive charge 85 as shown in FIG. 8. When the missile bullet 8 struck a hard object such as the ground surface or a wall, the impact force would cause the explosive charge 85 to generate an exploding sound, being similar to a real firearm. In order to protect children from being harmed when playing the toy, the conic portion 81 of the missile bullet 8 is furnished with a protective cap 86 made of soft rubber as shown in FIGS. 9 and 10. The rear end of the protective cap 86 has a fitting hole 861 to facilitate the cap 86 to be mounted on the conic portion 81. Since the protective cap 86 is made of soft rubber, it would not cause any injury upon shooting to some part of a person's body; in other words, the present invention is a safety toy.

Briefly, the air pistol toy according to the present invention is considered novel in terms of structure. By means of a logical assembly between the air-compression structure and the triggering mechanism, the pistol can have the missile bullets loaded in the revolving cylinder shoot out one after another to fulfill the requirements of a toy, i.e., the amusement and funny result. The front end of the missile bullet is mounted with an explosive charge or a soft protective cap so as to let the missile bullet generate an exploding sound, or shoot a person's body without causing any harm, but with more fun; therefore, the present invention is deemed a perfect toy air pistol.

I claim:

1. A toy air pistol structure for launching missile bullet mainly comprising two body parts, a revolving cylinder, a barrel, an air-compression mechanism, a triggering mechanism, several missile bullets and light means, in which:

said two body parts being fastened together to form the pistol body, and said body having a hollow space for mounting said air-compression mechanism and said triggering mechanism; and the middle portion of said body having a through hollow space for mounting said revolving cylinder; and an outer barrel portion of said body being fitted with said barrel; and a handle portion of said body having a hollow space as battery chamber; and at a suitable part of said pistol body, a bulb being installed; and one of said two body parts having a lateral channel portion extending to the rear of said body;

said revolving cylinder having a supporting pivot in the middle portion of said body extending out of the both ends thereof being used as a pivot; and said revolving cylinder being furnished with a plurality of cartridge chambers for loading said missile bullets respectively; and the rear end of said cylinder being provided with a plurality of driven teeth corresponding to said cartridge chambers in terms of number and position; and one of said cartridge chambers being in alignment with said barrel and an air hole of said air-compression mechanism;

said barrel being mounted in said outer barrel portion, and being in alignment with said air hole of said air-compression mechanism:

said light means including a leaf-spring switch, said bulb and a battery set; and said leaf-spring switch being installed above said battery chamber, and being electrically connected with said bulb and said battery set by means of wires; and said bulb being lighted up upon said trigger being pulled; and the prime features of said air pistol are that said air-compression mechanism includes a cylinder, a piston, a compression spring, and a rear cap; and said cylinder having two sets of lugs so as to facilitate said cylinder to be fixed in said body portion, and the front end of said cylinder having an air hole being in communication with the through hollow space of said body portion; and the both sides of said cylinder having a slot extending from the mid-portion of said cylinder to the rear end thereof; and an elongated hole being furnished under the mid-portion of said cylinder;

said piston being mounted inside said cylinder, and the front end of said piston being in a sealed condition and being mounted with a flexible collar seal; and the rear end thereof having an open and deep hole in which a rod and said compression spring being installed; and the rear side of said piston having a pulling handle to extend out of said slot of said cylinder and out of said lateral channel portion of said pistol body; and also a stop hole being furnished under the front end of said piston;

said compression spring being mounted in said cylinder but being sleeved around said rod; and the front end of said compression spring being inserted into the rear end hole of said piston, while the rear end thereof being positioned in said rear cap mounted on said cylinder so as to constantly maintain a pushing force against said piston;

said rear cap being mounted on the rear end of said cylinder and being positioned at the rear end of said pistol body;

said triggering mechanism including a trigger, a stop lever, a rocking lever and a driving lever, and in said triggering mechanism:

said trigger being mounted in lower part of the hollow space in said body by means of a supporting axle, and the upper rear edge of said trigger having a curved recess;

said stop lever being pivotally mounted to said body by means of a screw in the mid-part of said lever; and the rear end of said stop lever having an upward bent part being used as a stop member upon moving upwards at an angle because of said stop member extending into an elongated hole of said cylinder, and the front end of said stop lever having a downward bent part being used as a pushing member; and between said pushing member and said screw, one end of a pulling spring being fixed in position with another screw, while the other end of said pulling spring being fixed with a screw on said pistol body portion so as to have said stop member maintained always in upward position after being pushed back each time;

said rocking lever, of which one end being fastened with a screw to said body portion under said stop lever, while the free end of said rocking lever having a round and smooth portion being engaged in a curved recess on said trigger; and the mid-part of said rocking lever being mounted with a pulling spring by means of a screw, while the other end of said pulling spring being fixed at the same position as that of said pulling spring of said stop lever; and said free end of said rocking lever being always pulled downwards so as to let said lever return to its former position after being pushed each time;

said driving lever being fastened to said free end of said rocking lever, and the upper end of said driving lever having a right-angle bent part extending in said barrel direction, and extending through said body portion to engage with one of driven teeth on said revolving cylinder; and according to the aforesaid structure, said piston in said air-compression mechanism can be pulled backwards at a given distance by means of said handle until the stop hole of said piston and the elongated hole of said cylinder being in alignment, and then the stop member of said stop lever entering into said piston to hold said piston in position; and when pulling said trigger, said rocking lever being pushed upwards to actuate said driving lever to move upwards so as to drive said revolving cylinder to make step rotation; and when said trigger being pulled continuously, the pushing member of said stop lever being moved upwards to cause the stop member of said stop lever to move downwards to release said piston, which will move forwards swiftly to generate a powerful air pressure out of the air hole of said cylinder so as to drive said missile bullet out of said barrel.

2. A toy air pistol structure as claimed in claim 1, wherein the missile bullet is made of a light plastic material molded into a shape, of which the front end has conic portion, while the rear end thereof is formed into a trumpet-shaped tail, and the body portion of said missile bullet is furnished with a plurality of stabilizing fins spaced apart from one another regularly, and the inside of said missile bullet has an air chamber of which the front end is sealed, while the rear end of said air chamber is in communication with said trumpet-shaped tail; and the front end of said missile bullet is mounted with an explosive charge or is mounted with a soft plastic protective cap.

* * * * *